United States Patent [19]

Wackerman

[11] 4,184,595

[45] Jan. 22, 1980

[54] CARRYING DEVICE FOR POTTED PLANTS OR SIMILAR ARTICLES

[76] Inventor: Martha Wackerman, 119 Rices Mill Rd., Wyncote, Pa. 19095

[21] Appl. No.: 904,428

[22] Filed: May 10, 1978

[51] Int. Cl.[2] ..... B65D 5/46; B65D 85/52

[52] U.S. Cl. ..... 206/423; 206/427; 224/45 R; 229/52 BC

[58] Field of Search ..... 206/423, 523, 427, 45.19; 229/52 BC, 29 F; 224/45 R

[56] References Cited

U.S. PATENT DOCUMENTS

| | | | |
|---|---|---|---|
| 1,226,150 | 5/1917 | Warren | 229/29 F |
| 2,160,551 | 5/1939 | Lupton | 229/52 BC |
| 3,261,456 | 7/1966 | Sparks | 206/523 |

FOREIGN PATENT DOCUMENTS

| | | | |
|---|---|---|---|
| 1016308 | 1/1966 | United Kingdom | 229/523 |

*Primary Examiner*—William T. Dixson, Jr.
*Attorney, Agent, or Firm*—Weiser, Stapler & Spivak

[57] ABSTRACT

A foldable carrying device, adapted to transport a potted plant or similar article therein, comprising a solid base, carrying straps extending upwardly from opposing edges of the base and a raised platform overfitting the base and adapted to retain the potted plant or article within the enclosure formed by the base and the carrying straps. The carrying device is formed from a blank which is capable of laying flat and being stacked during storage and shipment and is designed to be easily folded immediately prior to use.

4 Claims, 6 Drawing Figures

CARRYING DEVICE FOR POTTED PLANTS OR SIMILAR ARTICLES

BACKGROUND OF THE INVENTION

This invention relates to a carrying device, capable of easy formation by folding a blank and which is adapted to retain a potted plant or other article within the enclosure which results when the blank is folded.

Retail sales of many articles often present special packaging requirements and problems. This is particularly so where the item sold is fragile or delicate in nature. Especially in the case of sale of potted plants, the problems are further complicated by the need to assure that the plant remains healthy after packaging and carrying home.

These packaging requirements must be balanced with several physical limitations that generally exist in connection with the packaging of an article for delivery or shipment. For example, the package should not be so complex as to present difficulties in manufacturing or storage. This is important for two reasons. Firstly, if the package is too complex, a seller will be reluctant to use it in favor of a somewhat less effective yet less complex package. Additionally, as the complexity of the package increases, so does the cost of producing such an article. Since the packaging generally represents a fixed cost which must be absorbed within the selling price of an item, it is extremely important to minimize the cost of producing a packaging device.

A further physical limitation for such a package is that, as an incidental part of a sale only, the package should not require an excess amount of storage space since such requirements would necessarily detract from the useful storage and sales space available for the actual business being conducted. Thus it is common practice to utilize a package which may be folded from a blank, the blanks being capable of storage in a flat, stacked fashion prior to use. In developing such a package blank, the complexity of the folding process, as well as the strength of the resulting package must be considered.

As previously mentioned, when the article to be packaged is a plant, still further problems arise. For example, a plant must be placed in a pot or other container provided with soil, generally moist soil. The resulting combination is often rather heavy and requires that any carrying device provided must be sufficiently sturdy to support the weight of the plant and its environment when carried for delivery to its destination. In the case of retail sales, the purchaser must find some convenient method for securely transporting the potted plant without damage to the delicate structure.

A plant requires oxygen and light during packaging and must be physically protected to assure that the plant remains healthy until it arrives at its destination. As a result, it is required that the package be designed with sufficient openings to provide the plant with fresh air and light. However, these open spaces serve to reduce the overall strength of the package, which, as previously mentioned, must be sufficiently sturdy to support relatively heavy contents.

In addition, plants generally require water to remain healthy and therefore most potted plants require moist soil during carrying or shipment. As a result, a certain degree of leakage through the base of the pot is possible. Accordingly, it is desirable that an enclosed base be provided so that escaping water will not cause damage to a surface upon which the package is placed. Again, since leaking water can reduce the strength of the package upon which it leaks, further attention must be paid to providing sufficient support for the contents of the package.

As another consideration, marketing of an article such as a plant often takes place in a rigid paced environment, for example a sidewalk sale or a flower show. As a result, it is desirable to provide a package which may be quickly assembled, is easy to use, and is inexpensive in construction to maximize sales potential.

A carrying device having all of the special characteristics and capability above described is not known to have heretofore existed.

SUMMARY OF THE INVENTION

This invention relates to a carrying device capable of formation by folding a package blank, the package blank being capable of laying flat when stored, the carrying device being adapted to securely retain a potted plant or other article within the enclosure which results when the blank is folded and the device is carried.

The carrying device is formed by properly folding a unitary package blank which is capable of production and storage in a substantially flat configuration. The blank is provided with a firm base, carrying straps integrally extending outwardly from opposing sides of the base, and a raised floor portion or platform which is attached to the base and which is capable of retaining the potted plant or article within the enclosure formed when the blank is folded to the carrying configuration.

The raised floor portion is provided with one or more cut outs which form openings of configuration to accept and retain the base of the potted plant or other article to be carried. Accordingly, the particular configuration of the openings of the raised platform determines the size and type of item which may be placed within the carrying device.

For the convenience of the user of the carrying device, the carrying straps are preferably provided with a handle, or other means for supporting the carrying device.

Accordingly, it is an object of the present invention to provide an improved carrying device which is capable of supporting a potted plant or other article therein.

It is another object of the present invention to provide a novel carrying device which may be formed by folding a precut and scored unitary blank.

It is another object of the present invention to provide a carrying device which may be formed by folding a precut and scored blank which is substantially flat when unfolded.

It is another object of the present invention to provide a carrying device which may be formed by folding a precut and scored blank which is capable of being stored in stacks one upon the other.

It is another object of the present invention to provide a carrying device which may be formed by folding a precut and scored blank which is capable of being mass produced.

It is another object of the present invention to provide a carrying device which may be formed by folding a precut and scored blank in a quick and simple manner.

It is another object of the present invention to provide a carrying device which may be formed by folding a precut and scored blank, the carrying device being adapted to discourage water from leaking from its bottom.

It is another object of the present invention to provide a carrying device which may be formed by folding a precut and scored blank, the carrying device being capable of admitting air and light to the interior of the device.

It is another object of the present invention to provide a carrying device which may be formed by folding a precut and scored blank, the carrying device being commercially acceptable for marketing small items using a variety of marketing techniques.

It is another object of the present invention to provide a carrying device which may be formed by folding a precut and scored blank, which is simple in design, inexpensive in manufacture and easy to assemble.

These objects and others will become apparent to those skilled in the art from the following disclosure of the preferred embodiment of the invention taken in conjunction with the drawings provided in which like reference characters refer to similar parts throughout the several views, in which:

DESCRIPTION OF THE PREFERRED EMBODIMENT OF THE INVENTION

Figure 2:
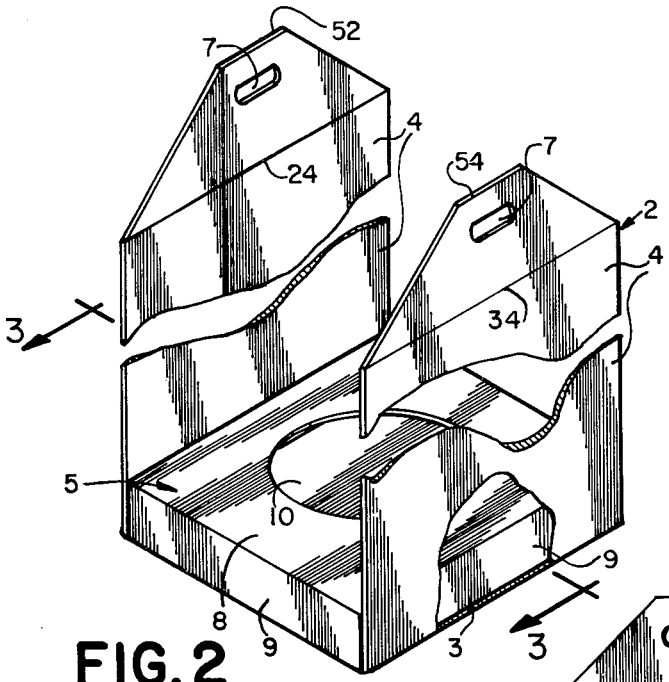
FIG. 2 is an isometric view of the carrying device after the blank has been folded, portions of which have been broken away to expose details of interior construction.

Although specific terms are used in the following description for the sake of clarity, these terms are intended to refer only to the particular structure of the invention selected for illustration in the drawings, and are not intended to define or limit the scope of the invention.

Figure 1:
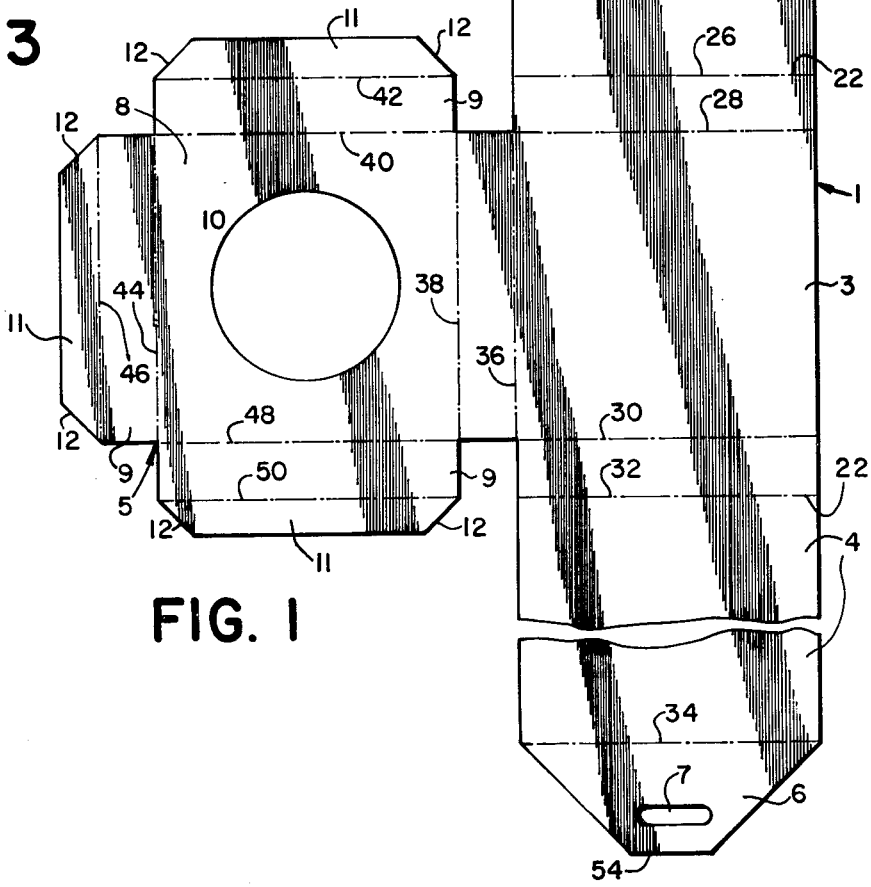
FIG. 1 is a top plan view of a package blank used to form the carrying device.

Referring now to the drawings, there is shown in FIG. 1 the preferred embodiment of the package blank 1 which when folded along the designated score lines forms the carrying device 2. The package blank 1 generally comprises a firm base panel or medial base 3, a pair of carrying straps and a raised platform portion 5 which is capable of retaining an article (not shown) in position after it has been placed within the folded carrying device.

The base panel 3 is illustrated in square configuration defined by first, second, third and fourth edges, but this panel may alternately be rectangular, or even a more complex shape if desired. The base panel 3 is solid construction to discourage or prevent the leakage of water or other substances therethrough.

The carrying straps 4 integrally extend from opposing edges of the base panel 3. This construction assures that the folded carrying device 2 will provide proper support for the articles being carried, for example, one or more potted plants (not shown). The straps 4, although illustrated as rectangular in shape, may be die cut or otherwise formed to any other suitable shape. It is possible to provide each carrying strap 4 with cut out patterns (not shown) to admit additional air and light to the interior of the carrying device 2 after it has been folded to provide a decorative effect. If such cut out areas are provided, it must be assured that sufficient strength is maintained by the straps 4 to properly support the contents within the carrying device 2.

Each carrying strap 4 is provided with an end portion 6 integrally formed as part of the strap 4. The end portion 6 is used to provide a convenient handle to hold the carrying device 2 after it has been folded. The end portions 6 extend from the edges of the carrying straps 4 opposite to those which connect the carrying straps 4 to the base panel 3. This configuration assures central placement of the end portions 6 at the top of the carrying device 2 after it has been folded to provide a balanced assembly.

The top portions 6 may also be provided with a cut out opening to define a handle 7 which is integrally formed as part thereof. The handle 7 permits the carrying device 2 to be easily lifted and carried by inserting a hand through the pair of adjacent openings. It is also possible, but less desirable, to use separate handles (not shown) with the carrying device 2. These may be attached in known manner to the carrying device 2 after it has been folded.

The raised platform 5 comprises a retention member 8 and a plurality of spacer legs 9, the combination of which is integrally connected to one edge of the base 3. The retention member 8 is pre-cut to the same configuration and size as the base 3 in order to maximize the useful surface area available for retaining an article in place. However such equivalence in shape and size is not required to practice the invention and in some cases, it may be desirable to vary the shape and size of the retention member 8 from that of the base 3, for example, to permit additional inward folding of the carrying straps 4.

The retention member 8 is provided with one or more openings 10 which are configured to accept and retain the base of an article in place within the folded carrying device 2. Accordingly it is preferred, although not required, that the openings 10 be closely configured to conform to the base of the article to be placed in the carrying device 2 to optimize the support provided to that article. In FIG. 1 only a single large opening 10 is illustrated. However, it is equally possible to provide a plurality of openings 10, having a variety of shapes and sizes, depending upon the particular application of the carrying device 2.

The retention member 8 is provided with a plurality of support legs 9 which serve to space the retention member 8 away from the base 3 when the package blank 1 is folded. Each leg 9 is integrally formed as part of the retention member 8 and one leg 9 is integrally connected to the base 3. In this manner, all features of the package blank 1 may be formed in a unitary blank while also permitting easy folding of the blank 1 into the carrying device 2. The width of the legs 9 determines the height of the retention member 8 with respect to the base 3. This distance may be varied according to need for a given application.

With the exception of the leg 9 connected to the base panel 3, each leg 9 may be provided with a flap 11 which furnishes additioal support for the leg 9 when it is placed on the base 3 in the manner more fully described below. The flaps 11 are integrally formed as part of the legs 9 to enable unitary fabrication of the package blank 1.

Both the legs 9 and flaps 11 are illustrated as extending the entire length and width of the retention member 8, the flaps 11 having angled portions 12 facilitating assembly of the structure as folding takes place. Although this configuration is preferable to provide maximum support, it is equally possible for the legs 9 or the flaps 11 to extend only partially along the edges of the retention member 8.

The package blank 1 is generally formed of a planar product such as cardboard or corrugated board. Other materials such as sheet plastics could also be used but such materials tend to be more expensive. By using such planar materials, the package blank 1 and its integral features are easily formed by stamping, die-cutting or pressing the blank 1 from sheets of material using any of several known processes. It is contemplated that in a single manufacturing step, the outline of the blank 1 can be formed, the cut-outs 7, and 10 can be provided and the respective score lines 24, 26, 28, 30, 32, 34, 36, 38, 40, 42, 44, 46, 48 and 50 can be impressed.

The score lines 24, 26 define a first rise section and the score lines 30, 32 define a second rise section respectively therebetween. The straps 4, the first and second rise sections and the medial base 3 linearly align along one side to form a linear edge. The platform strip comprising the retention member 8 is spaced from and extends away from the linear edge in a right angle relationship.

The foregoing describes a unitary package blank 1 which may be inexpensively mass produced and which is capable of forming a sturdy carrying device when suitably folded along the respective score lines. It is also possible to manufacture the package blank 1 in separate parts for subsequent assembly. However, this is less desirable than the unitary construction. To facilitate the folding process, the edges connecting the base panel 3, the carrying straps 4, the top portions 6, the retention member 8, the legs 9 and the flaps 11 preferably are scored during the manufacture of the package blank 1.

The package blank 1 of FIG. 1 may quickly and easily be folded to form the carrying device 2 illustrated in FIG. 2. The following procedure illustrates one method by which such a folding operation may be accomplished.

Starting with a planar blank 1 as illustrated in FIG. 1, the flaps 11 are bent upwardly at approximately a ninety degree angle to the plane defined by the package blank itself along the score lines 42, 46, 50. The legs 9, other than the leg 9 connecting the base 3 to the retention member 8, are next bent upwardly, again at approximately a ninety degree angle to the plane defined by the base panel 3 along the score lines 40, 44, 48. Next, the retention member 8 is folded upwardly at 38 along the edge of the leg 9 which connects the retention member 8 to the base 3. The leg 9 attached to the base 3 is then folded upwardly along the score line 36. Both upward folds would be made at substantially a ninety degree angle.

Figure 3:
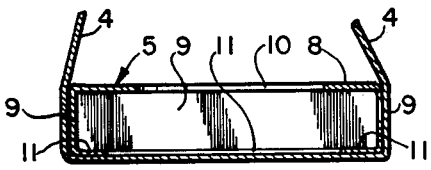
FIG. 3 is a sectional view of the folded carrying device taken along line 3—3 of FIG. 2, looking in the direction of the arrows.

Having performed the above steps, the base panel 3 is provided with a raised platform 5, the combination being well suited to supporting an article therein. The interconnection between the base 2 and the elements forming the raised base 5 is illustrated in FIGS. 2 and 3. The raised platform 5 may simply be rested upon the base panel 3 as described above, or if preferred, the flaps 11 may be bonded in place by utilizing a suitable known adhesive. The bonding agent may be applied after assembly, or if preferred, may be placed upon the flaps 11 during manufacture of the flat blank 1 for use during assembly. Peel strips (not shown) may be employed to protect the adhesive surface until use. Next, the carrying straps 4 are folded upwardly along the score lines 28, 32 to form the finished carrying device shown in FIG. 2. The sides 4 are bowed inwardly over the score lines 26, 32 to meet along the top portions 6. The jointed top portions 6 are employed as a convenient means for holding the carrying device 2. The handles 7 provide further convenience for lifting and holding the carrying device 2. If desired, the carrying strap extremities 52, 54 may be stapled or glued together upon assembly to maintain the device in assembled relationship. After assembly, an article, such as a potted plant (not shown) can be readily transported by placing the bottom of the pot through the opening 10 and resting the pot bottom directly upon the base panel 3. This double layer construction provides firm support for the pot both vertically and in all horizontal directions.

For the convenience of the user, the top portions 6 may be folded back slightly so that the two top portions 6 are in parallel alignment when brought together. Further, for user convenience, each carrying strap 4 may be provided with an additional fold at 22. The additional fold 22 permits the sides 4 to be slanted toward each other without requiring that they be bowed inwardly where such a configuration is deemed desirable. The distance between the respective score lines 26, 28 and 30, 32 is equal to the height of the legs 9 whereby the carrying straps 4 are foldable over the top surface of the retention member 8.

Figure 6:
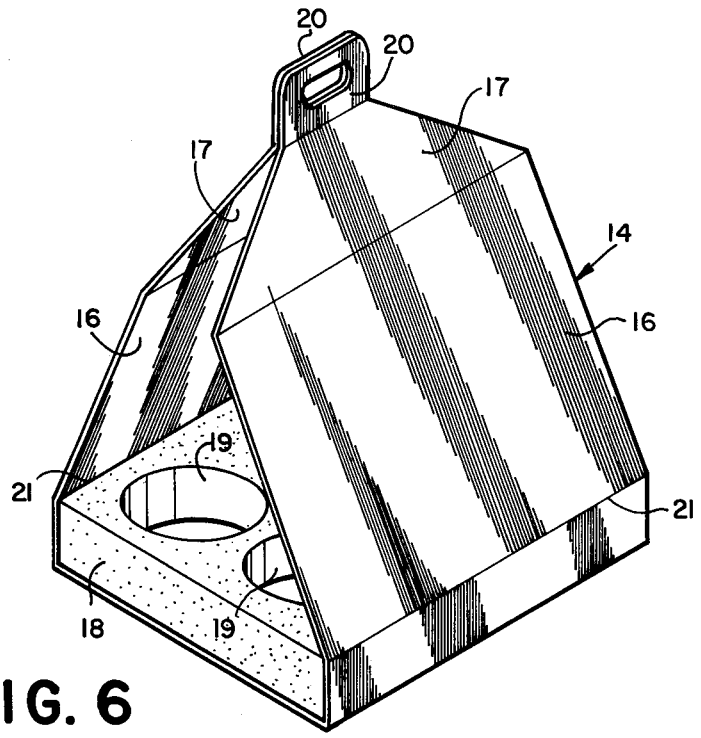
FIG. 6 is an isometric view of the carrying device of FIGS. 4 and 5 after the blank has been folded.
Figure 5:
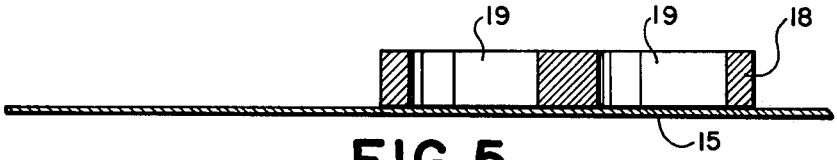
FIG. 5 is an enlarged, side elevational view looking from line 5—5 of FIG. 4, showing the raised platform of the carrying device.
Figure 4:
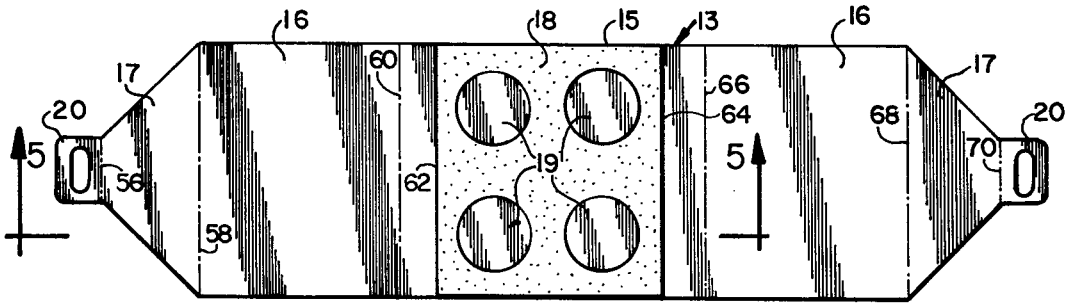
FIG. 4 is a top plan view of a second embodiment of a package blank used to form the carrying device.

FIGS. 4–6 illustrate an alternative embodiment of the package blank and carrying device. The modified package blank 13 comprises a solid base 15, a pair of opposed carrying straps 16 integrally connected to the solid base 15, respective end portions 17 integrally connected to each carrying strap 16 and a raised retention member 18.

In this embodiment, as best seen in FIGS. 5 and 6, the raised central portion 18 comprises a separate, unitary member which provides the thickness required to retain an article within the modified folded carrying device 14. The raised portion 18 may be formed from a variety of construction materials, for example, styrofoam, corrugated board, or wood. The thickness of the raised portion 18 preferably is similar to the height of the raised platform 5 of FIG. 3 to possess the same retention qualities. The dimensions of the raised portion 18 are preferably equivalent to those of the base 15, however smaller dimensions may be utilized if desirable or necessary for any particular application. One or more openings 19 are provided to retain the article or articles to be transported in place, their number, shape and size depending upon the particular configuration desired.

Similar to the embodiment illustrated in FIGS. 1–3, the end portions 17 may be provided with handles 20, and the various folding lines 56, 58, 60, 62, 64, 66, 68, 70 may be scored for ease of assembly.

Assembly of the carrying device 14 of FIG. 6 is performed by a simple series of folding steps. The raised portion 18 is bonded to the base 15 either during manufacture of the package blank 13, or during assembly of the carrying device 14 just prior to its use.

The carrying straps 16 are folded upwardly from the base 15 along the score lines 62, 64 to form the enclosure of the carrying device 14. Similar to the carrying device 2 of FIG. 2, the end portions 17 may be folded back slightly along the score lines 58, 60 to bring them into parallel alignment when brought together. An additional fold at the score lines 60, 60 may be provided to slant the carrying straps 16 toward each other without requiring that they be bowed inwardly. The carrying device 14 may then be used by placing flower pots (not shown) or other articles into the openings 19. It will be noted that portions of the planar base 15 are exposed through the openings 19 to thereby provide firm support for all articles being carried.

It may therefore be seen that the above disclosed invention serves well to accomplish the objects previously stated. It will also be seen that the invention may be embodied in other specific forms in addition to those specifically disclosed and therefore the disclosure made should be interpreted in an illustrative and not a limiting sense.

What is claimed is:

1. A carrying device adapted for planar arrangement during shipping and being capable after delivery of being folded to retain and transport an article comprising an integral elongated carrying strip of foldable material defining a linear edge, a plurality of transverse, spaced, score lines in said carrying strip, a medial base defined by said score lines, said base having a first edge in alignment with the strip, a second edge spaced from the first edge and in alignment with the strip, a third edge joining the first and second edges and forming part of the said linear edge and a fourth edge joining the first and second edges and being parallel to the third edge, a first rise section defined by the score lines, the first rise section extending integrally from the medial base first edge, a part of the first rise section forming a portion of the said linear edge, a second rise section defined by the score lines and extending integrally from the medial base second edge, a part of the second rise section forming a portion of the said linear edge, a first and second carrying strap defined by the score lines, the first and second carrying strap extending integrally from the first and second rise section, a part of the first and second carrying strap forming a part of the linear edge; and a platform strip integral with the carrying strip and extending in length in a direction away from the linear edge, a plurality of longitudinal and transverse score lines in the platform strip, a retention member defined in the platform strip by longitudinal score lines in spaced relationship from the carrying strip, the retention member having a first transverse edge, a second transverse edge in spaced relationship to the first edge, a third longitudinal edge joining the first and second edges and a fourth longitudinal edge joining the first and second edges, a first spacer leg integrally extending from the first transverse edge, a second spacer leg integrally extending from the second transverse edge, a third spacer leg extending from the third longitudinal edge and a fourth spacer leg integrally extending from the fourth longitudinal edge, the height of the first, second, third and fourth spacer legs being equal to each other and to the height of the first and second rise sections of the carrying strip, the platform strip being adapted to be folded about the score lines to position the retention member in registry over the medial base, the first, second, third and fourth spacer legs being adapted to be folded about a score line to contact the medial base and to support the retention member along its transverse and longitudinal edges in spaced relationship above the medial base, the retention member being provided with at least one opening whereby an article to be carried can be placed directly upon the medical base through the opening for vertical support and whereby the portions of the retention member defining the opening provide horizontal retention for the article.

2. The carrying device of claim 1 wherein the third spacer leg of the platfrom strip integrally joins the carrying strip in spaced relationship from the linear edge.

3. The carrying device of claim 1 wherein strengthening flaps extend from at least three of the spacer legs, the flaps being adapted to be folded about score lines to contact the medial base when the retention member is folded into registry above the medial base.

4. The carrying device of claim 1 wherein the spacer legs define a fully enclosed spaced between the medial base and the retention member when the retention member is folded into registry above the medial base.

* * * * *